US006864447B1

(12) United States Patent
Lipsey, II et al.

(10) Patent No.: US 6,864,447 B1
(45) Date of Patent: Mar. 8, 2005

(54) CIRCUIT BREAKER EMPOLYING ILLUMINATING INDICATORS FOR OPEN AND CLOSED POSITIONS

(75) Inventors: Percy J. Lipsey, II, Coraopolis, PA (US); Martha Suryani, Moon Township, PA (US); Craig J. Puhalla, Moon Township, PA (US); Raymond P. Gundy, II, Indiana, PA (US)

(73) Assignee: Eaton Corporation, Cleveland, OH (US)

( * ) Notice: Subject to any disclaimer, the term of this patent is extended or adjusted under 35 U.S.C. 154(b) by 68 days.

(21) Appl. No.: 10/650,343

(22) Filed: Aug. 28, 2003

(51) Int. Cl.[7] ..... H01H 9/00

(52) U.S. Cl. ..... 200/310; 200/312; 200/315; 335/17

(58) Field of Search ..... 200/310, 312, 200/308, 315, 317; 335/17, 132

(56) References Cited

U.S. PATENT DOCUMENTS

| | | | | |
|---|---|---|---|---|
| 3,329,913 A | | 7/1967 | Camp | |
| 3,742,402 A | | 6/1973 | Nicol et al. | |
| 3,742,403 A | | 6/1973 | Nicol | |
| 3,806,848 A | | 4/1974 | Harper et al. | |
| 3,863,042 A | | 1/1975 | Nicol | |
| 3,955,162 A | | 5/1976 | Nicol | |
| 4,151,386 A | | 4/1979 | Nicol et al. | |
| 4,267,539 A | | 5/1981 | Guinan | |
| 4,344,100 A | * | 8/1982 | Davidson et al. | 361/45 |
| 4,768,025 A | * | 8/1988 | Vila-Masot | 340/638 |
| 4,926,148 A | | 5/1990 | Cambreleng | |
| 4,963,847 A | | 10/1990 | Cambreleng et al. | |
| 4,969,063 A | * | 11/1990 | Scott et al. | 361/93.1 |
| 5,546,266 A | | 8/1996 | Mackenzie et al. | |
| 5,847,913 A | | 12/1998 | Turner et al. | |
| 6,031,438 A | * | 2/2000 | Runyan | 335/172 |
| 6,075,215 A | | 6/2000 | Bollinger, Jr. et al. | |
| 6,246,304 B1 | * | 6/2001 | Gasper | 335/17 |
| 6,342,995 B1 | * | 1/2002 | Jones | 361/62 |
| 6,365,855 B1 | | 4/2002 | Sutter et al. | |
| 6,542,056 B2 | | 4/2003 | Nerstrom et al. | |

* cited by examiner

*Primary Examiner*—Kyung Lee
(74) *Attorney, Agent, or Firm*—Martin J. Moran

(57) ABSTRACT

A circuit breaker includes a housing, a pair of separable contacts within the housing, and an operating mechanism having an operating handle for opening and closing the separable contacts. A micro-switch cooperates with the operating handle and provides a first output when the separable contacts are open and a second output when the separable contacts are closed. A first LED indicator protrudes through the housing and cooperates the first output of the micro-switch. The first LED indicator is illuminated when the separable contacts are open. A second LED indicator protrudes through the housing and cooperates with the second output of the micro-switch. The second LED indicator is illuminated when the separable contacts are closed.

17 Claims, 4 Drawing Sheets

CIRCUIT BREAKER EMPOLYING ILLUMINATING INDICATORS FOR OPEN AND CLOSED POSITIONS

CROSS-REFERENCE TO RELATED APPLICATION

This application is related to commonly assigned, concurrently filed U.S. patent application Ser. No. 10/650,342 filed Aug. 28, 2003, entitled "Circuit Breaker Employing an Illuminated Operating Handle"

BACKGROUND OF THE INVENTION

1. Field of the Invention

This invention relates generally to circuit breakers and, more particularly, to circuit breakers including an operating mechanism.

2. Background Information

Circuit breakers are disclosed, for example, in U.S. Pat. Nos. 3,329,913; 3,955,162; 4,151,386; 4,267,539; 4,926,148; and 4,963,847.

Hydraulic and electromagnetic circuit breakers typically comprise a movable contact, which is mounted on a movable arm, and a fixed or stationary contact. An operating handle is coupled to the movable arm via a linkage mechanism, part of which comprises a collapsible toggle assembly. The movable and stationary contacts are operated between contacts "open" and contacts "closed" positions by pivoting the operating handle. The circuit breaker further comprises a hydraulic or electromagnetic device which, in response to one or more predetermined electrical conditions, collapses the toggle assembly to a broken state, in order to trip "open" the separable movable and stationary contacts. Typically, the operating handle assumes one of two or three positions (e.g., "on", "off" and "tripped") corresponding to the contacts "closed" position, contacts "open" position, and contacts tripped "open" position.

Users who apply circuit breakers in relatively dark enclosures or other relatively dark environments desire a relatively quicker and more efficient mechanism than, for example, employing fixed or portable enclosure lighting for identifying when a circuit breaker has been turned off or tripped. Otherwise, there is a "guessing game" of whether a circuit breaker is in the "on" position versus the "off" or tripped "off" position(s).

Accordingly, there is room for improvement in circuit breakers.

SUMMARY OF THE INVENTION

These needs and others are met by the present invention, which provides two illuminable indicators to indicate: (1) the "on" position (contacts "closed"); and (2) the "off" or tripped "off" positions (contacts "open" or contacts tripped "open" positions). Accordingly, this gives users, such as maintenance personnel, an instant indication of the circuit breaker status without having to employ, for example, fixed or portable enclosure lighting. Therefore, this permits the user to immediately locate the interrupted or otherwise opened circuit, and to reset or close the appropriate circuit breaker.

In accordance with the invention, a circuit breaker comprises: a housing; separable contacts within the housing; an operating mechanism for opening and closing the separable contacts; means for providing a first output when the separable contacts are open and a second output when the separable contacts are closed; a first indicator cooperating the first output of the means for providing, the first indicator being illuminated when the separable contacts are open; and a second indicator cooperating the second output of the means for providing, the second indicator being illuminated when the separable contacts are closed.

The first indicator may be a first LED, and the second indicator may be a second LED. The first and second LEDs may form a dual LED package.

The first LED may include a first anode and a first cathode, and the second LED may include a second anode and a second cathode, which is electrically connected to the first cathode of the first LED. The first and second cathodes may be electrically connected to a resistor, which is adapted to be electrically connected to a common of a power source external to the circuit breaker.

The means for providing may be an auxiliary switch cooperating with the operating mechanism. The auxiliary switch may include an operating member cooperating with the operating mechanism, a common terminal, a normally open terminal providing the first output and a normally closed terminal providing the second output. The first anode of the first LED may be electrically connected to the normally open terminal of the auxiliary switch. The second anode of the second LED may be electrically connected to the normally closed terminal of the auxiliary switch.

The first indicator may have a first color, and the second indicator may have a second different color.

The operating mechanism may include a trip unit. The separable contacts may include an open position, a closed position and a tripped open position. The means for providing may provide the first output for the open and tripped open positions of the separable contacts, and provide the second output for the closed position of the separable contacts.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
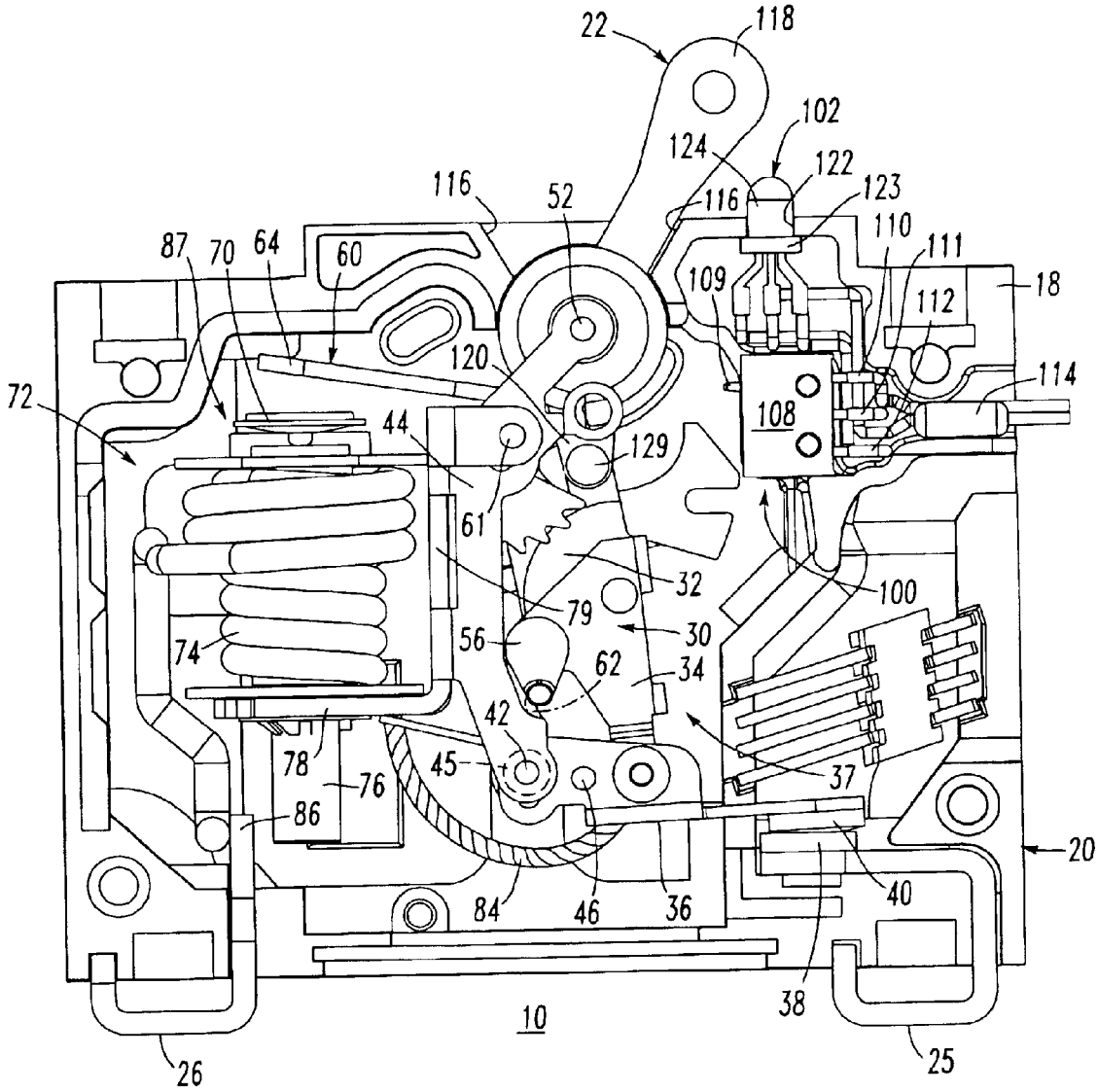
FIG. 1 is a vertical elevation view of a circuit breaker incorporating the present invention, with one-half case being removed to show the general internal arrangement and to illustrate the separable contacts in the closed position.
Figure 2:
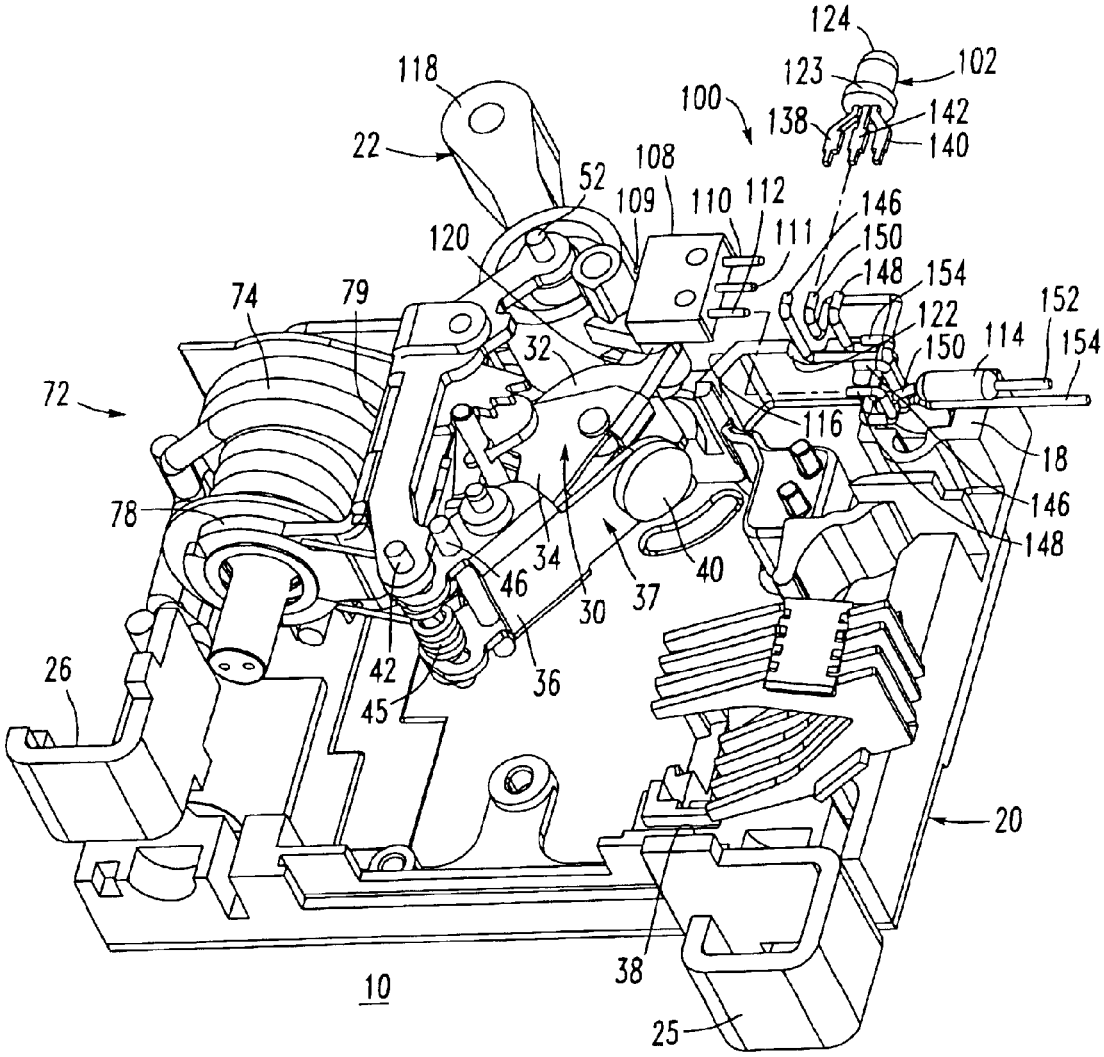
FIG. 2 is an isometric view of the circuit breaker of FIG. 1 with one-half case being removed to show the general internal arrangement and with the separable contacts in the open position.

Referring to FIGS. 1 and 2, the invention will be described as applied to a circuit breaker 10 for use in direct current (DC) telecommunication systems (e.g., 60 VDC; 65 VDC; 80 VDC). It will become evident that the invention is applicable to other types of circuit breakers including those used in alternating current (AC) systems operating at various frequencies; to relatively smaller or larger circuit breakers, such as subminiature or miniature circuit breakers; and to a wide range of circuit breaker applications, such as, for example, residential, commercial, industrial, aerospace, and automotive. As further non-limiting examples, both AC (e.g., 110, 120, 220, 240, 480–600 VAC) operation at a wide range of frequencies (e.g., 50, 60, 120, 400 Hz) and DC operation (e.g., 42, 60 VDC) are possible.

The circuit breaker 10 is generally similar to ones disclosed in U.S. Pat. Nos. 3,329,913; 4,151,386; 4,267,539; and 4,963,847, which are hereby incorporated by reference herein. The circuit breaker 10 includes an insulating case 20 formed by abutting half-cases, such as 18 (the other half-case is not shown), an operating handle 22, and terminals 25 and 26 for connecting the circuit breaker 10 to a load (not shown). Pivotally connected to the handle 22 is a toggle linkage 30. A movable arm 36 is pivotally connected to the toggle linkage 30. The handle 22, the toggle linkage 30 and the movable arm 36, together with a hydraulic or electromagnetic tripping device or sensing element 87, jointly comprise the operating mechanism 37 of the circuit breaker 10. The terminal 25 supports a stationary contact 38 which cooperates with a movable contact 40, the latter being carried by the movable arm 36. The movable arm 36 pivots about a pintle 42, carried by a frame 44, and is biased to the open position of the contacts 38,40 by a spring 45 between the frame 44 and a pin 46 which passes through the movable arm 36.

The toggle linkage 30, which includes a first link 32 and a second link 34, is pivotally connected at its lower (with respect to FIGS. 1 and 2) end to the movable arm 36 and at its upper (with respect to FIGS. 1 and 2) end to the handle 22. The handle 22 oscillates about a fixed pintle 52, which is carried by the frame 44, and is biased to the "off" or open position of the contacts 38,40 by a reset spring (not shown) between the frame 44 and the handle 22. That reset spring also automatically resets the toggle linkage 30 after it has collapsed, as is discussed below.

For locking the toggle linkage 30 in the overcenter position during automatic resetting, the toggle linkage 30 includes a latch mechanism comprising a spring biased latch 56 carried by the second toggle link 34. The latch 56 is tripped by a pivotal armature 60 having three legs, namely, a first or unlatching leg 62, a second or attractable leg 64 and a third or substantially balancing leg (not shown). The unlatching leg 62 (as shown in phantom line drawing in FIG. 1) engages the latch 56 and turns it (counter-clockwise with respect to FIGS. 1 and 2) to unlatch the toggle linkage 30, thereby allowing the toggle linkage 30 to collapse under the bias of the opening spring 45 when the attractable leg 64 is pivoted sufficiently toward the pole piece 70 of an electromagnet 72 (upon predetermined overload) to bring the unlatching leg 62 into engagement with the latch 56. Further, the armature 60 pivots about a pin 61 carried by the frame 44.

The electromagnet 72 comprises a solenoid coil 74 about a tube 76, the latter projecting through a first leg 78 of the frame 44. The second frame leg 79 extends longitudinally along the coil 74, as shown. The tube 76 is of non-magnetic material and houses a movable core (not shown) of magnetizable material biased by a spring (not shown) disposed toward the lower (with respect to FIGS. 1 and 2) end of the tube 76. The moveable core is retarded in its upward (with respect to FIGS. 1 and 2) movement by a liquid, preferably a silicone oil, within the tube 76 to provide a time delay below certain overload currents before tripping of the circuit breaker 10 takes place. The coil 74 has one end connected to the movable arm 36 by a flexible conductor 84 and the other end connected by a conductor 86 to the terminal 26. Thus, the electromagnetic tripping device or sensing element 87 is formed by the coil 74, the tube 76, the movable core within the tube 76, and the armature 60 for tripping the circuit breaker 10 after a time delay period at certain overloads or substantially instantaneously at higher overloads.

FIGS. 1 and 2 show the closed and open positions, respectively, of the operating mechanism 37, the operating handle 22 and the separable contacts 38,40. In the present circuit breaker 10, the tripped open position of the operating handle 22 is the same as the open position thereof. Alternatively, the invention is applicable to a circuit breaker (not shown) in which in a third, or tripped open position, the operating handle thereof is intermediate the on and off positions of FIGS. 1 and 2. Regardless, for the tripped open position, the toggle linkage 30 is broken (not shown) by operation of the latch 56 and the electromagnetic tripping device or sensing element 87.

Figure 3:
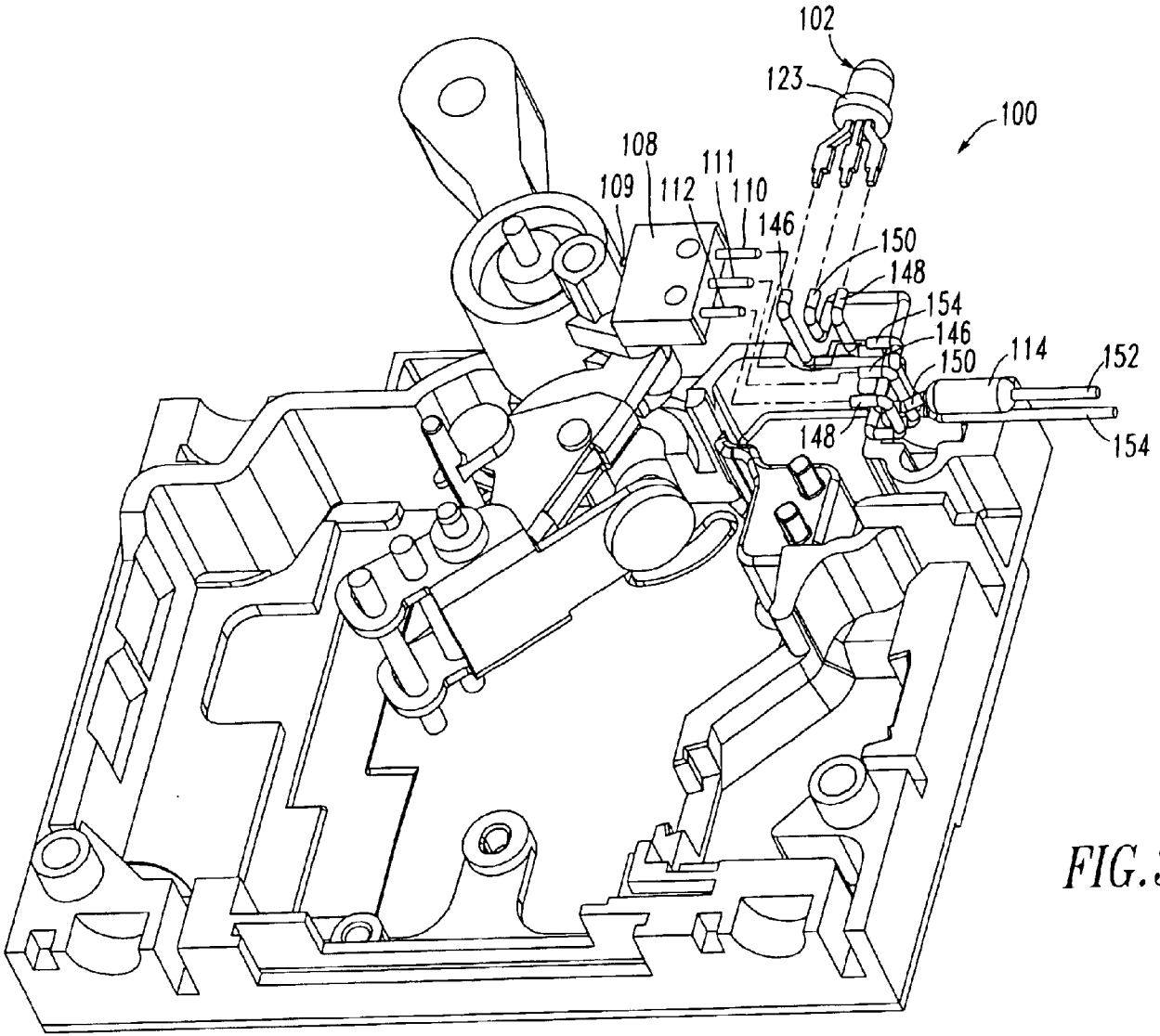
FIG. 3 is an exploded isometric view, which is similar to FIG. 2, except that the tripping device is not shown.
Figure 5:
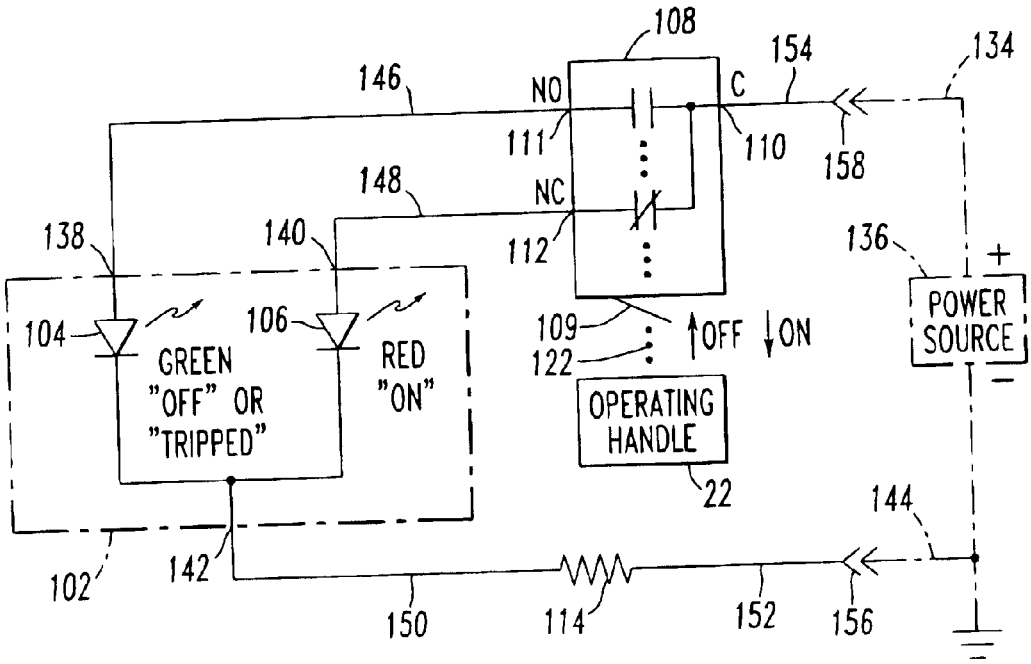
FIG. 5 is a schematic diagram showing the micro-switch, the dual LED, the resistor and the electrical connections of FIG. 1.

In accordance with the present invention, as shown in FIGS. 1–3, a circuit 100 provides a first output when the separable contacts 38,40 are open (e.g., "off" or tripped "off" positions) and a second output when the separable contacts 38,40 are closed (e.g., "on" position). An indicator, such as a dual LED indicator 102, includes a first indicator (e.g., LED) 104 and a second indicator (e.g., LED) 106 (the two indicators 104,106 are shown in FIG. 5). The first indicator 104 cooperates with the first output of the circuit 100 and is illuminated when the separable contacts 38,40 are open. The second indicator 106 cooperates with the second output of the circuit 100 and is illuminated when the separable contacts 38,40 are closed. The circuit 100 includes an auxiliary switch, such as a micro-switch 108, having an operating member, such as actuator 109, a common terminal 110, a normally open (NO) terminal 111 and a normally closed (NC) terminal 112 and, also, includes a resistor 114. The NO terminal 111 and the NC terminal 112 provide the first and second outputs, respectively, of the circuit 100.

As shown in FIGS. 1 and 2, the housing 20 includes an opening 116 for the operating handle 22, which is employed to manually operate the operating mechanism 37. The operating handle 22 includes a first portion 118 extending through the housing opening 116 and a second portion 120 within the housing 20. The micro-switch actuator 109 cooperates with the operating mechanism 37 in general, and with the second portion 120 of the operating handle 22 in particular, in order to toggle the first and second outputs of the micro-switch 108. The housing 20 also includes an opening 122 through which an indicating portion 124 of the dual LED indicator 102 is suitably mounted (e.g., compression fit; held by lip 123 of LED indicator 102 and corresponding leads).

Figure 4:
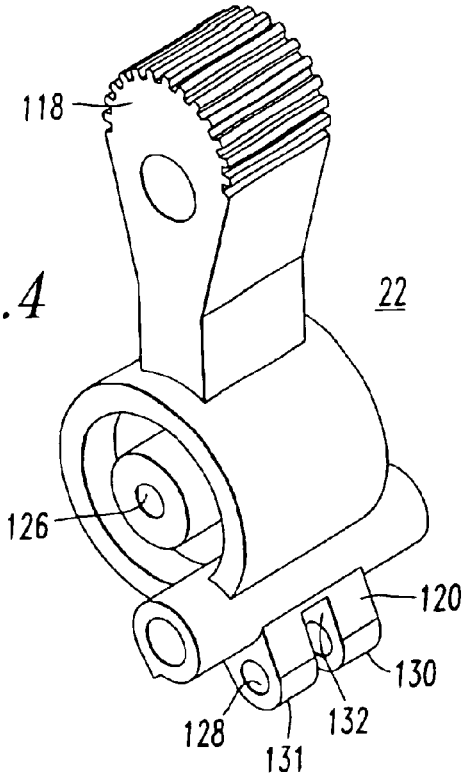
FIG. 4 is an isometric view of the operating handle of FIG. 1.

Referring to FIGS. 2, 4 and 5, the operating handle second portion 120 engages the micro-switch actuator 109 in the open ("off") position of the separable contacts 38,40. As shown in FIGS. 1 and 5, the operating handle second portion 120 disengages from the micro-switch actuator 109 in the closed ("on") position of the separable contacts 38,40. The actuated position of the actuator 109 provides the micro-switch first output (e.g., the NO terminal 111 is electrically connected to the common terminal 110) for the open and tripped open positions of the separable contacts 38,40. Conversely, the non-actuated position of the actuator 109 provides the micro-switch second output (e.g., the NC terminal 112 is electrically connected to the common terminal 110) for the closed position of the separable contacts 38,40.

As shown in FIG. 4, the operating handle 22 includes the first and second portions 118,120, an opening 126 for the fixed pintle 52, an opening 128 for a pivot pin 129 (shown in FIGS. 1 and 2) for the link 32, and a pair of legs 130,131 with a space 132 therebetween to receive the link 32. The end of the leg 130 engages the micro-switch actuator 109 in the open ("off") position of the separable contacts 38,40.

Referring to FIG. 5, the common terminal 110 of the micro-switch 108 is adapted to receive a voltage 134 and, thus, be energized from a power supply, such as power source 136 (shown in phantom line drawing), which is external to the circuit breaker 10 of FIG. 1. The dual LED 102 also includes two terminals 138,140, which are adapted to be energized through the micro-switch terminals 111,112, respectively, from the power source 136. The cathodes of the individual LEDs 104,106 are electrically connected within the dual LED 102, while the anodes of the individual LEDs 104,106 are electrically connected to the terminals 138,140, respectively. The dual LED 102 includes a third terminal 142, which, along with the LED cathodes, are electrically connected to the resistor 114, which, in turn, is adapted to be electrically interconnected with the common 144 of the power source 136. In this manner, the anode of the first LED 104 is electrically connected to the NO terminal 111 of the micro-switch 108, and the anode of the second LED 106 is electrically connected to the NC terminal 112 of the micro-switch 108, which selectively energizes and illuminates one of the LEDs 104,106 from the voltage 134 of the power source 136 at common terminal 110 and back through the resistor 114 to the power source common 144. It will be appreciated that a resistor (not shown) may be electrically interconnected between the voltage 134 of the power source 136 and the micro-switch common terminal 110 in addition to, or in place of, the resistor 114.

As shown in FIGS. 2, 3 and 5, a first conductor 146 from the LED 104 of the dual LED 102 is electrically connected to the micro-switch NO terminal 111. A second conductor 148 from the LED 106 of the dual LED 102 is electrically connected to the micro-switch NC terminal 112. A third conductor 150 from the cathodes of the dual LED 102 is electrically connected to the resistor 114, in order to limit the LED current and, thereby, prevent the dual LED from burning out. In turn, the resistor 114 is electrically interconnected by a fourth conductor 152 with the common 144 of the power source 136. The micro-switch common terminal 110 is electrically interconnected by a fifth conductor 154 with the voltage 134 of the power source 136. Preferably, the conductors 146, 148, 150, 152, 154 are electrically insulated. Preferably, the conductors 152,154 include suitable terminations, such as 156,158, respectively, of FIG. 5 for suitable electrical connection to the external power source 136.

The auxiliary micro-switch 108 is set internal to the circuit breaker 10. As the circuit breaker 10 is toggled between "off" (or the tripped "off") and the "on" positions, the dual LED 102 is toggled back and forth between a green light, which indicates "off" or tripped "off", and a red light, which indicates that the circuit breaker is "on".

Although LED indicators 104,106 in a dual LED package 102 are disclosed, the invention is applicable to any suitable indicator(s), which may be suitably illuminated to show the open and closed positions of separable contacts, such as 38,40. For example, any suitable illuminable indicator(s) and combinations thereof may be employed (e.g., a dual indicator; two individual indicators; lamp(s), light(s); any suitable illuminating device(s)).

In the exemplary embodiment, the first indicator 104 has a first color (e.g., green; any suitable color), and the second indicator 106 has a second different color (e.g., red; any suitable color). It will be appreciated that these colors may be swapped or that a wide range of suitable colors may be employed. Alternatively, one of the indicators 104,106 may employ a suitable color, and the other one of the indicators 104,106 may employ the same suitable color, which is illuminated with a suitable on/off modulation by a suitable circuit (not shown). Alternatively, a single indicator (not shown) may be employed which is illuminated in a suitable color for one of the "on" and "off" positions, and is illuminated in the same suitable color with a suitable on/off modulation by a suitable circuit (not shown) for the other one of the "on" and "off", positions. Alternatively, a third indicator may be employed for the tripped "off" position.

Although a circuit 100 including an auxiliary switch 42 providing the outputs to the indicators 104,106 is disclosed, any suitable circuit and/or mechanism may be provided in order to provide outputs corresponding to the open and closed states of separable contacts. As another alternative, one indicator may illuminate for the tripped open state and another indicator may illuminate for the not tripped open state (e.g., open or closed) with the linkage 30 being unbroken.

Although an external power source 136 is shown, the invention is applicable to circuit breakers employing a suitable internal power source (not shown).

Although a single pole circuit breaker 10 is disclosed, the invention is applicable to circuit breakers and other electrical switching devices having any count of poles and with or without a suitable trip mechanism (e.g., hydraulic; electromagnetic; magnetic; thermal).

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A circuit breaker comprising:

a housing;

separable contacts within said housing;

an operating mechanism for opening and closing said separable contacts;

a micro-switch including an operating member cooperating with said operating mechanism, a common terminal, a first terminal providing a first output when said separable contacts are open and a second terminal providing a second output when said separable contacts are closed, the common terminal of said micro-switch being electrically isolated from said separable contacts and being adapted to receive a voltage from a power supply external to said circuit breaker;

a first indicator cooperating with the first output of said micro-switch, said first indicator being illuminated when said separable contacts are open; and a second indicator cooperating with the second output of said micro-switch, said second indicator being illuminated when said separable contacts are closed.

2. The circuit breaker of claim 1 wherein said first terminal is a normally open terminal providing said first output and said second terminal is a normally closed terminal providing said second output.

3. The circuit breaker of claim 1 wherein said micro-switch is mounted within said housing; wherein the common terminal of said micro-switch is a first common terminal; wherein said first and second indicators include a second common terminal; wherein said voltage is a direct current voltage; and wherein the first and second common terminals are adapted to be energized from said direct current voltage.

4. The circuit breaker of claim 1 wherein said first indicator is a first LED; and wherein said second indicator is a second LED.

5. The circuit breaker of claim 1 wherein said first indicator has a first color, and wherein said second indicator has a second different color.

6. The circuit breaker of claim 5 wherein said first color is green; and wherein said second color is red.

7. The circuit breaker of claim 1 wherein said first indicator is a first LED; wherein said second indicator is a second LED; and wherein said first and second LEDs form a dual LED package.

8. The circuit breaker of claim 7 wherein said first terminal is a normally open terminal providing said first output and said second terminal is a normally closed terminal providing said second output.

9. The circuit breaker of claim 8 wherein said first LED includes a first anode and a first cathode; and wherein said second LED includes a second anode and a second cathode, which is electrically connected to the first cathode of said first LED.

10. The circuit breaker of claim 9 wherein the first and second cathodes are electrically connected to a resistor, which is adapted to be electrically interconnected with a common of said power source external to said circuit breaker.

11. The circuit breaker of claim 9 wherein the first anode of said first LED is electrically connected to the normally open terminal of said micro-switch; and wherein the second anode of said second LED is electrically connected to the normally closed terminal of said micro-switch.

12. The circuit breaker of claim 1 wherein said housing includes an opening; wherein said operating mechanism includes an operating handle operating said operating mechanism, said operating handle including a first portion extending through the opening of said housing and a second portion within said housing; and wherein the operating member of said micro-switch cooperates with the second portion of said operating handle.

13. The circuit breaker of claim 12 wherein the second portion of said operating handle engages the operating member of said micro-switch in the open position of said separable contacts and is disengaged from the operating member of said micro-switch in the closed position of said separable contacts.

14. The circuit breaker of claim 1 wherein said housing is a case including an opening.

15. The circuit breaker of claim 14 wherein said first indicator is a first LED; wherein said second indicator is a second LED; and wherein said first and second LEDs form a dual LED package, which protrudes through the opening of said case.

16. The circuit breaker of claim 14 wherein at least one of the first and second indicators is an LED, which protrudes through the opening of said case.

17. The circuit breaker of claim 1 wherein said operating mechanism includes a trip unit; wherein said separable contacts include an open position, a closed position and a tripped open position; and wherein said micro-switch provides said first output for the open and tripped open positions of said separable contacts, and provides said second output for the closed position of said separable contacts.

* * * * *